US007047929B2

(12) United States Patent
Aketa et al.

(10) Patent No.: US 7,047,929 B2
(45) Date of Patent: May 23, 2006

(54) ENGINE AND A METHOD FOR PRODUCING THE ENGINE

(75) Inventors: Masahiro Aketa, Sakai (JP); Wataru Iwanaga, Sakai (JP); Yuzo Umeda, Sakai (JP)

(73) Assignee: Kubota Corporation, Osaka (JP)

( * ) Notice: Subject to any disclaimer, the term of this patent is extended or adjusted under 35 U.S.C. 154(b) by 27 days.

(21) Appl. No.: 10/382,698

(22) Filed: Mar. 6, 2003

(65) Prior Publication Data

US 2004/0159303 A1 Aug. 19, 2004

(30) Foreign Application Priority Data

Feb. 14, 2003 (JP) ..... P 2003-035861

(51) Int. Cl.
*F02B 67/04* (2006.01)

(52) U.S. Cl. ..... 123/195 R

(58) Field of Classification Search ..... 123/195 R, 123/195 A, 509, 90.27
See application file for complete search history.

(56) References Cited

U.S. PATENT DOCUMENTS

| | | | | |
|---|---|---|---|---|
| 3,452,610 | A | 7/1969 | Beasley et al. | |
| 4,321,896 | A * | 3/1982 | Kasting | 123/195 A |
| 4,459,950 | A * | 7/1984 | Kasting | 123/195 A |
| 4,573,439 | A * | 3/1986 | Kasting | 123/195 A |
| 4,615,308 | A * | 10/1986 | Asanomi et al. | 123/90.27 |
| 5,918,573 | A * | 7/1999 | Killion | 123/192.2 |
| 5,992,393 | A * | 11/1999 | Yoshida et al. | 123/509 |
| 6,286,475 | B1 * | 9/2001 | Pierro | 123/195 A |
| 6,415,758 | B1 * | 7/2002 | Pierro et al. | 123/195 R |
| 6,415,759 | B1 * | 7/2002 | Ohrnberger et al. | 123/195 A |

FOREIGN PATENT DOCUMENTS

| | | |
|---|---|---|
| DE | 32 14 096 A1 | 11/1982 |
| JP | 2000-186564 A | 7/2000 |

* cited by examiner

*Primary Examiner*—Henry C. Yuen
*Assistant Examiner*—Jason Benton
(74) *Attorney, Agent, or Firm*—Akin Gump Strauss Hauer & Feld, LLP

(57) ABSTRACT

The present invention relates to an engine and a method for producing the engine.

The engine is constructed as follows.

The engine interlockingly operates a pump (39, 139) for feeding fuel under pressure, by power of a crank shaft (1). A pair of gears (32*a*) and (32*b*) are arranged to be attached to a gear attaching shaft (32). The paired gears (32*a*) and (32*b*) are attached to the gear attaching shaft (32). At least one gear (32*a*) of the paired gears (32*a*) and (32*b*) constitutes a gear train (14, 114) through which the power of the crank shaft (1) is transmitted to the pump (39, 139).

The method for producing the engine is constructed as follows.

The method uses a common part for each of the gear trains (14) and (114) so as to produce engines of an injection pump specification and a common rail specification and alternatively manufactures the gear trains (14) and (114) through the common part. It comprises attaching a pair of gears (32*a*) and (32*b*) to a gear attaching shaft (32) of the engine of every specification, making one gear (32*a*) of the paired gears (32*a*) and (32*b*) serve as a basic gear and the other gear (32*b*) serve as a second gear, employing the basic gear (32*a*) as the common part for each of the gear trains (14) and (114) and alternatively manufactures the gear trains (14) and (114) of the engines of the respective specifications through the basic gear (32*a*) of the common part.

9 Claims, 10 Drawing Sheets

ENGINE AND A METHOD FOR PRODUCING THE ENGINE

BACKGROUND OF THE INVENTION

1. Field of the Invention

The present invention relates to an engine and the method for producing the engine.

2. Explanation of Related Art

Conventionally, engines of different specifications, such as an engine of an injection pump specification and an engine of a common rail specification, cannot use any common part for gear trains and therefore employ exclusive parts therefor, respectively.

The conventional technique has the following problems.

Problem 1 The specification of the engine cannot be changed.

Conventionally, the engines of different specifications utilize their exclusive parts for their gear trains, respectively. Therefore, for example, it is impossible to interchange the specification between the engine of the injection pump specification, the engine of the common rail specification and the like.

Problem 2 It is impossible to alternatively manufacture the gear trains of the engines of different specifications through a common part.

Conventionally, since the engines of different specifications cannot use any common part for their gear trains, it is impossible to alternatively manufacture gear trains of engines of different specifications, for example, such as the injection pump specification and the common rail specification, by using a common part.

SUMMARY OF THE INVENTION

The present invention has an object to provide an engine and a method for producing the engine, which can solve the above problems.

1. Constructions of a First to a Seventeenth Inventions

A First Invention

As shown in FIGS. 1(A) and 1(B), the first invention is an engine which interlockingly operates a pump 39, 139 for feeding fuel under pressure, by power of a crank shaft 1 and attaches a pair of gears 32*a* and 32*b* to a gear attaching shaft 32. At least one gear 32*a* of the paired gears 32*a* and 32*b* is attached to the gear attaching shaft 32. The engine transmits the power of the crank shaft 1 to the pump 39, 139 through a gear train 14, 114 which comprises the at least one gear 32*a* of the paired gears 32*a* and 32*b*.

A Second to a Fourth Inventions

As shown in FIG. 1(A), each of the second to the fourth inventions is an engine of an injection pump specification, which attaches both of the paired gears 32*a* and 32*b* to a gear attaching shaft 32 to form a gear train 14 of a double-layer structure.

A Fifth Invention

As shown in FIG. 1(B), the fifth invention is an engine of a common rail specification which attaches at least one gear 32*a* of a pair of gears 32*a* and 32*b* to a gear attaching shaft 32 to form a gear train 114 of a single-layer structure.

A Sixth to an Eighth Inventions

As shown in FIG. 5, each of the sixth to the eighth inventions is an engine which separately arranges a wrapping transmission device 42 and the gear train 14, 114 at a front end portion and a rear end portion of a cylinder block 11.

A Ninth to a Twelfth Inventions

As shown in FIG. 4, each of the ninth to the twelfth inventions is an engine which arranges a crank gear 3 constituting the gear train 14, 114 at a position adjacent a flywheel 2.

A Thirteenth to a Sixteenth Inventions

As shown in FIGS. 1(A) and 1(B), each of the thirteenth to the sixteenth inventions is an engine which engages a balancer gear 37*a* with a valve operating cam gear 72*a* from above the gear 72*a* and arranges a balancer shaft 37 on one horizontal side of a cylinder 43 as shown in FIG. 9.

A Seventeenth Invention

As shown in FIGS. 1(A) and 1(B), the seventeenth invention is a method for producing engines of the injection pump specification and the common rail specification by using a common part for each of gear trains 14, 114. The method alternatively manufactures the gear trains 14, 114 of the engines of the respective specifications through the common part. This method attaches a pair of gears 32*a* and 32*b* to a gear attaching shaft 32 of an engine of every specification and makes one gear 32*a* of the paired gears 32*a* and 32*b* serve as a basic gear and the other gear 32*b* serve as a second gear. The basic gear 32*a* is utilized as a common part for each of the gear trains 14, 114. The method alternatively manufactures the gear trains 14 and 114 of the respective specifications through the basic gear 32*a* of the common part.

2. Advantages of the First to the Seventeenth Inventions

The First Invention

Advantage 1 It is possible to change the specification of the engine.

As shown in FIGS. 1(A) and 1(B), the present invention arranges so that the paired gears 32*a* and 32*b* can be attached to the gear attaching shaft 32. It attaches at least one gear 32*a* of the paired gears 32*a* and 32*b* to the gear attaching shaft 32 and transmits the power of the crank shaft 1 to the pump 39, 139 trough the gear train 14, 114 which employs at least one gear 32*a* of the paired gears 32*a* and 32*b*. Therefore, it becomes possible to interchange the specification between the engines of, for example, the injection pump specification, the common rail specification and the like specifications.

Advantage 2 It is possible to alternatively manufacture gear trains of engines of different specifications through a common part.

As shown in FIGS. 1(A) and 1(B), the present invention attaches a pair of gears 32*a* and 32*b* to a gear attaching shaft 32. Therefore, it becomes possible to alternatively manufacture gear trains 14 and 114 of engines of, for example, the injection pump specification, the common rail specification and the like different specification through a common part by making one gear 32*a* of the paired gears 32*a* and 32*b* serve as the common part for the engines of the different specifications.

Second Invention

Advantage 3 It becomes possible to change to the engine of the common rail specification or the like different specification.

As shown in FIG. 1(A), the present invention attaches a pair of gears 32*a* and 32*b* to a gear attaching shaft 32 in the engine of the injection pump specification. Accordingly, the engine of the injection pump specification can be changed to the engine of the common rail specification or the like different specification by changing the way of using the paired gears 32*a* and 32*b*.

Advantage 4 It is possible to alternatively manufacture gear trains of engines of different specifications through a common part.

As shown in FIG. 1(A), the present invention attaches a pair of gears 32*a* and 32*b* to a gear attaching shaft 32 in the engine of the injection pump specification. In consequence, it is possible to alternatively manufacture gear trains 14 and 114 of the engines of different specifications through a common part by making one gear 32*a* of these paired gears 32*a* and 32*b* serve as the common part for the gear train 114 of the engine of the common rail specification as shown in FIG. 1(B).

The Third Invention

Advantage 5 It is possible to downsize the gear train.

As shown in FIG. 1(A), the present invention forms the gear train 14 of the double-layer structure from the basic gear train 14*a* and the second gear train 14*b*. This makes it possible to determine a diameter of a gear which defines the second gear train 14*b*, irrespective of a diameter of a gear which constitutes the basic gear train 14*a*.

Based on the above construction, the present invention makes a diameter of each of the second gear 32*b* and an injection pump input gear 34*a* which define the second gear train 14*b* smaller than a diameter of the basic gear 32*a* which constitutes the basic gear train 14*a*.

The Fourth Invention

Advantage 6 It is possible to reduce engine's noise.

The present invention decreases a gear module of the second gear train 14*b* more than a gear module of the basic gear train 14*a* and therefore enables the gears of the second gear train 14*b* to engage with each other more smoothly by that decrease to result in the possibility of reducing the engine's noise.

Advantage 7 It is possible to reduce the production cost of the gear train.

The present invention increases the gear module of the basic gear train 14*a* more than the gear module of the second gear train 14*b* and therefore decreases the number of teeth of gears which form the basic gear train 14*a* by that increase to result in the possibility of reducing the production cost of the gear train 14.

The Fifth Invention

Advantage 8 It is possible to change to the engine of the injection pump specification or the like different specification.

As shown in FIG. 1(B), the present invention attaches a pair of gears 32*a* and 32*b* to a gear attaching shaft 32 in the engine of the common rail specification. Accordingly, it is possible to change it to the engine of the injection pump specification or the like different specification by changing the way of using this pair of gears 32*a* and 32*b*.

Advantage 9 It is possible to alternatively manufacture gear trains of the engines of different specifications through a common part.

As shown in FIG. 1(B), the present invention attaches a pair of gears 32*a* and 32*b* to a gear attaching shaft 32 in the engine of the common rail specification. Accordingly, it is possible to alternatively manufacture the gear trains 14 and 114 of the engines of different specifications through a common part by making one gear 32*a* of the paired gears 32*a* and 32*b* serve as the common part for the gear train 14 of the engine of the injection pump specification as shown in FIG. 1(A).

The Sixth Invention

Advantage 10 It is possible to decrease a horizontal width of engine.

As sown in FIG. 5, the present invention largely separates a wrapping transmission device 42 from a gear train 14, 114 in a front and rear direction. Thus there is no likelihood that a tensioner 47 of the wrapping transmission device 42 and the gear train 14, 114 are arranged side by side as shown in FIGS. 7 and 8 to result in the possibility of decreasing a horizontal width of the engine.

The Seventh Invention

Advantage 11 It is possible to reduce the horizontal width of the engine.

As shown in FIG. 5, the present invention largely separates the tensioner 47 from the pump 39, 139 in the front and rear direction. Consequently, as shown in FIGS. 7 and 8, there is no likelihood that these parts are arranged side by side to result in the possibility of reducing the horizontal width of the engine.

Advantage 12 It is possible to lessen restriction on the machine which loads the engine thereon.

As shown in FIG. 5, the present invention collects the tensioner 47 and the pump 39, 139 which need frequent maintenance and arranges them on one horizontal side of a cylinder block 11. Accordingly, the engine of the present invention can be loaded even on the machine which allows the maintenance only from one side to result in the possibility of lessening the restriction on the machine which loads the engine thereon.

Advantage 13 It is possible to enhance a working efficiency of the maintenance.

As mentioned above, the present invention collects the tensioner 47 and the pump 39, 139 which need frequent maintenance and arranges them on one horizontal side of the cylinder block 11 to result in the possibility of enhancing a working efficiency of the maintenance.

The Eighth Invention

Advantage 14 It is possible to decrease horizontal projection of parts.

As shown in FIG. 5, a generator 48 of a relatively large horizontal width and the pump 39, 139 are arranged on one horizontal side of an upper side portion 46*a* of the cylinder block 11 where a crank chamber 75 does not project horizontally. Thus it is possible to reduce the horizontal projection of parts as shown in FIGS. 7 and 8.

The Ninth Invention

Advantage 15 It is possible to inhibit vibration of the gear train.

As shown in FIG. 4(A), the present invention arranges a crank gear 3 at a position which comes to be a node of vibration of the crank shaft 1 and therefore reduces vibration of the crank gear 3 to result in the possibility of inhibiting the vibration of the gear train 14, 114.

The Tenth Invention

Advantage 16 It is possible to facilitate the manufacturing of the crank shaft and the crank gear.

As shown in FIG. 4(A), the present invention clearance fits the crank gear 3 to the crank shaft 1. Therefore, differently from the case of shrinkage fitting them to each other, a high dimension accuracy is not required for an outer diameter of the crank shaft 1 and an inner diameter of the crank gear 3 to result in the possibility of facilitating to manufacture the crank shaft 1 and the crank gear 3.

The Eleventh Invention

Advantage 17 Even in the case where the crank gear and the flywheel are fastened together, it is possible to make the gear train compact.

As shown in FIGS. 4(A) and 4(B), the present invention needs to increase a radius (r) of an imaginary circle 7 more than a predetermined length so as to secure a transmission torque from the crank shaft 1 to the crank gear 3 when fastening the crank gear 3 and the flywheel 2 together to the crank shaft 1. However, an attaching bolt 8 extends through the crank gear 3. Therefore, when compared with a case where the attaching bolt 8 is inserted into a crank gear fitting shaft portion 6, an outer diameter of the crank gear fitting shaft portion 6 is sufficient even if it is small. Thus a diameter of the crank gear 3 may be also small to result in the possibility of downsizing the gear train 14, 114.

The Twelfth Invention

Advantage 18 It is possible to shorten the entire length of the engine.

As shown in FIG. 4(A), the present invention forms an internally threaded portion 9 within an end journal 10. This dispenses away with a necessity of providing a shaft portion for forming an internally threaded portion between an end journal 4 and the crank gear fitting shaft portion 6 to result in the possibility of shortening the entire length of the engine.

Advantage 19 It is possible to secure a useful life of the crank shaft.

As shown in FIG. 4(A), the present invention increases an outer diameter of the end journal 4 from which a large stress occurs due to a reaction force of the gear train 14,114 or the like, more than that of the other end journal 10 of the crank shaft 1. Thus it can secure a useful life of the crank shaft 1.

The Thirteenth Invention

Advantage 20 It is possible to inhibit the enlargement of the engine attributable to the arrangement of a balancer shaft.

As shown in FIG. 9, the present invention arranges a balancer shaft 37 on one horizontal side of a cylinder 43, which comes to be a dead space. Therefore, it does not have to extend the crank chamber 75 laterally or downwardly so as to secure a space for arranging the balancer shaft 37. This can inhibit the enlargement of the engine attributable to the arrangement of the balancer shaft 37.

The Fourteenth Invention

Advantage 21 It is possible to downsize the engine.

As shown in FIG. 9, the present invention arranges the balancer shaft 37, a side water passage 77 and a valve operating cam shaft 72 vertically in a compact manner. Accordingly, it can downsize the engine.

The Fifteenth Invention

Advantage 22 It is possible to uniformly effect the warming and the cooling of walls of the whole engine.

As shown in FIG. 10, the present invention arranges a plurality of outlets 77*a* so that they are distributed longitudinally of the side water passage 77. Therefore, it can distribute cooling water to the walls of the whole cylinders 43, 43 with the result of being able to uniformly warm and cool the walls of the whole cylinders 43, 43.

The Sixteenth Invention

Advantage 23 It is possible to downsize the engine.

As shown in FIG. 10, the present invention effectively utilizes an interior area within a wall, which comes to a dead space, and provides a tappet guide hole 79 therein to result in the possibility of downsizing the engine.

The Seventeenth Invention

Advantage 24 It is possible to reduce the production cost of every engine.

As shown in FIGS. 1(A) and 1(B), the present invention alternatively manufacture the gear trains 14 and 114 of the engines of the injection pump specification and the common rail specification through a common part for producing the engine of the respective specifications to result in reducing the parts cost of each of the gear trains 14 and 114, which in turn can reduce the production cost of every engine.

DESCRIPTION OF THE PREFERRED EMBODIMENTS

An embodiment of the present invention is explained with respect to the attached drawings. FIGS. 1 to 10 show the embodiment of the present invention. In this embodiment, an explanation is given for a vertical multi-cylinder diesel engine and a method for producing the diesel engine in this embodiment.

The embodiment is outlined as follows.

Figure 1A:
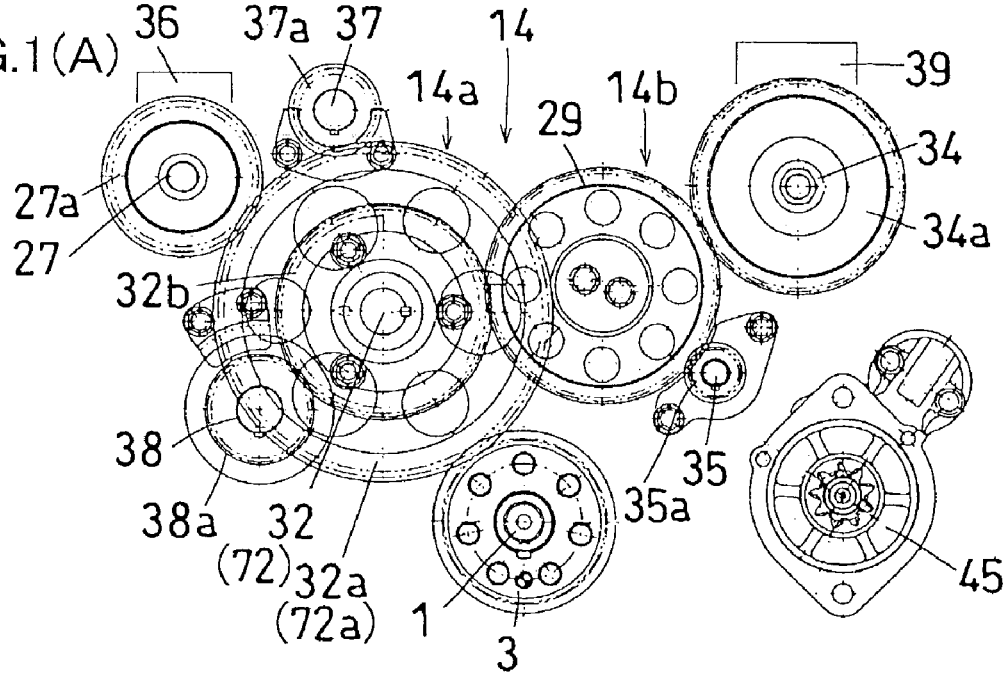
FIG. 1(A) shows a gear train of an engine of an injection pump specification according to an embodiment of the present invention.
Figure 1B:
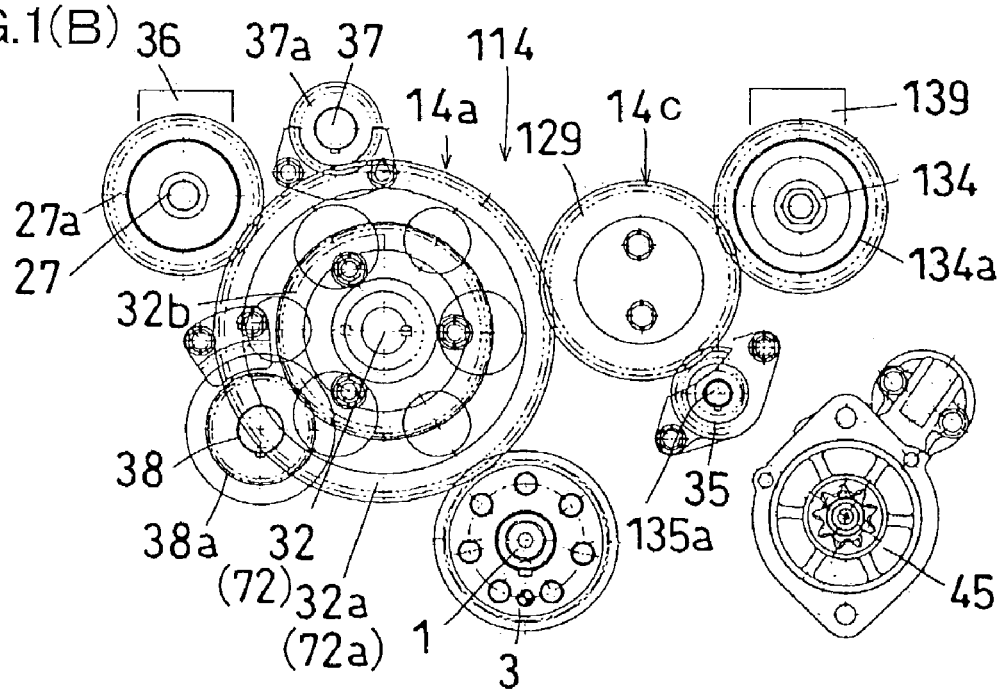
FIG. 1(B) shows a gear train of an engine of a common rail specification according to the embodiment of the present invention.
Figure 2:
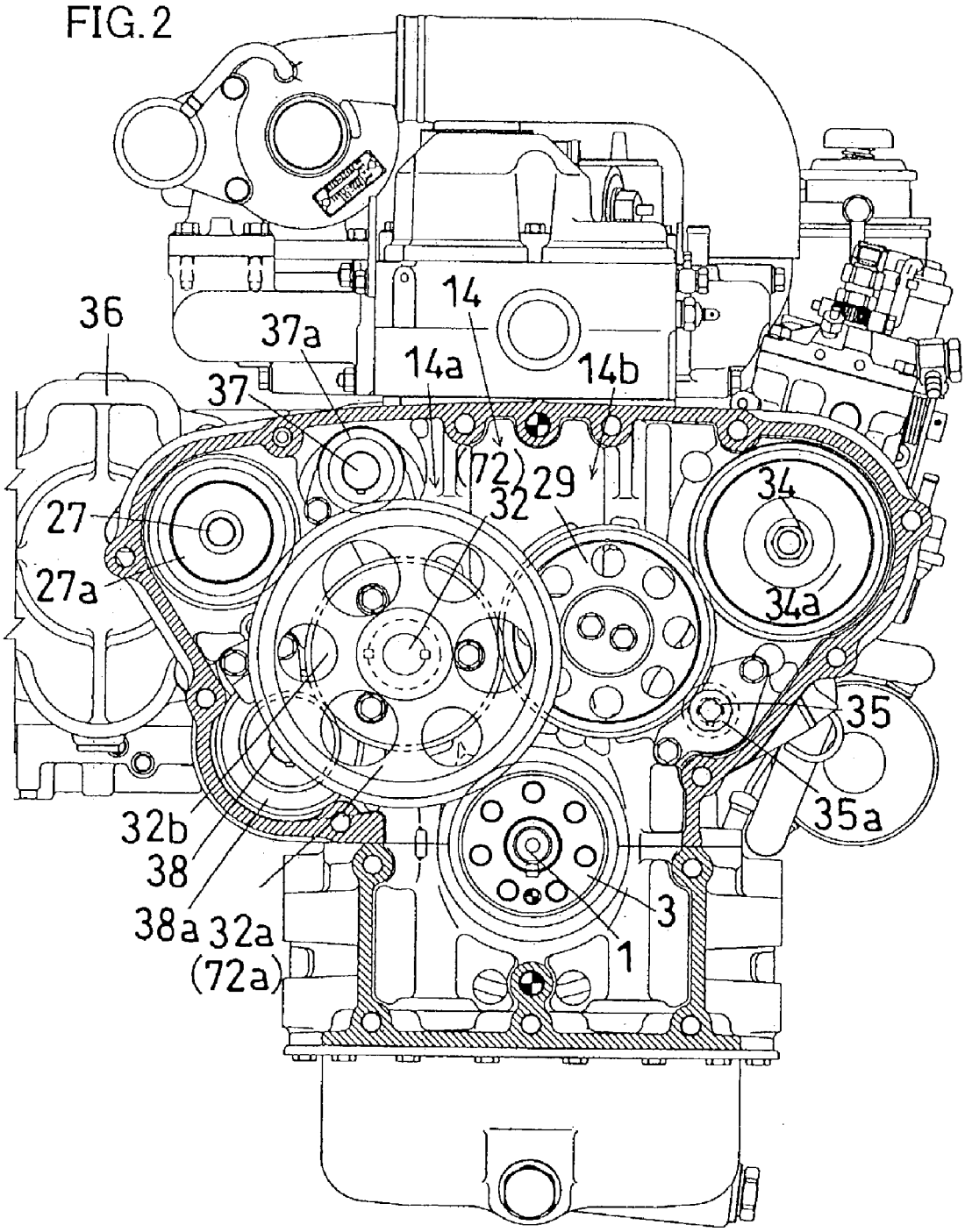
FIG. 2 is a rear view of the engine of the injection pump specification according to the embodiment of the present invention.

FIG. 1(A) explains a gear train of an engine of an injection pump specification according to the embodiment of the present invention. FIG. 1(B) explains a gear train of an engine of a common rail specification according to the embodiment of the present invention. This embodiment concerns engines of the respective specifications provided with the gear trains alternatively manufactured through a common part and a method for producing the engines through the alternative manufacturing of the gear trains.

The engine of every specification is outlined as follows.

As shown in FIGS. 1(A) and 1(B), the engine of every specification interlockingly operates a pump 39, 139 which feeds fuel under pressure, by power of a crank shaft 1. The power of the crank shaft 1 is transmitted to every pump 39, 139 trough each of gear trains 14, 114.

The engines of the respective specifications are different from each other and are common to one another on the following points.

While the engine of the injection pump specification shown in FIG. 1(A) has an injection system extending from the fuel injection pump 39 to a fuel injection nozzle, the engine of the common rail specification shown in FIG. 1(B) includes an injection system extending from the fuel supply pump 139 to the fuel injection nozzle. The engines of the respective specifications differ from each other in the construction of this injection system. Further, they are partly distinguished from one another in the construction of every gear train 14, 114. They are common in all of the other constructions.

The gear trains 14 and 114 of the engines of the respective specifications are common to each other as follows.

As shown in FIGS. 1(A) and 1(B), a pair of gears 32*a* and 32*b* are attached to a gear attaching shaft 32. One gear 32*a* of the paired gears 32*a* and 32*b* serves as a basic gear and the other gear serves as a second gear. The basic gear 32*a* is attached to the gear attaching shaft 32 and constitutes a basic gear train 14*a* together with a crank gear 1. This crank gear 1 and the basic gear 32*a* come to be common parts for each of the gear trains 14 and 114.

Although each of the gear trains 14 and 114 of the engines of the respective specifications employs the second gear 32*b*, the engine of the common rail specification as shown in FIG. 1(B) does not use this second gear 32*b* as a constituent part of the gear train 14 but employs it only for interlockingly operating a primary balancer shaft 38. Therefore, the engine of the common rail specification need not use the second gear 32*b* when it does not employ the primary balancer shaft 38. This second gear 32*b* is not a common part for each of the gear trains 14 and 114.

What is peculiar to the gear train 14 of the engine of the injection pump specification is as follows.

As shown in FIG. 1(A), the second gear 32*b*, an idle gear 29 of the injection pump specification, and an injection pump input gear 34*a* engage with each other in the mentioned order to constitute a second gear train 14*b*. The basic gear train 14*a* and the second gear train 14*b* form a gear train 14 of a double-layer structure. The power of a crank shaft 1 is transmitted to the fuel injection pump 39 through the gear train 14. Each of the second gear 32*b* and the injection pump input gear 34*a* which define the second gear train 14*b* has a diameter smaller than a diameter of the basic gear 32*a* which forms the basic gear train 14*a*. The second gear train 14*b* has a gear module smaller than a gear module of the basic gear train 14*a*.

What is peculiar to the gear train 114 of the engine of the common rail specification is as follows.

As shown in FIG. 1(B), an idle gear 129 of the common rail specification engages with a supply pump input gear 134*a* to form an extended gear train 14*c*. The basic gear 32*a* engages with the idle gear 129 to form a gear train 114 of a single-layer structure together with the basic gear train 14*a* and the extended gear train 14*c*. The power of the crank shaft 1 is transmitted to the fuel supply pump 139 through the gear train 114.

Gears in the vicinity of the gear train 14, 114 of the engine of every specification engage with each other as follows.

They are common in that as shown in FIGS. 1(A) and 1(B), the basic gear 32*a* engages with an output take-out gear 27*a* and a first secondary balancer gear 37*a*, respectively and further in that the second gear 32*b* engages with a primary balancer gear 38*a*. The are different from each other in that as shown in FIG. 1(A), while in the case of the gear train 14 of the injection pump specification, the idle gear 29 engages with a second secondary balancer gear 35*a* of a smaller gear module, in the case of the gear train 114 of the common rail specification as shown in FIG. 1(B), the idle gear 129 engages with a second secondary balancer gear 135*a* of a larger gear module.

The gears of the engines of the respective specifications are supported by the following structures.

Figure 3:
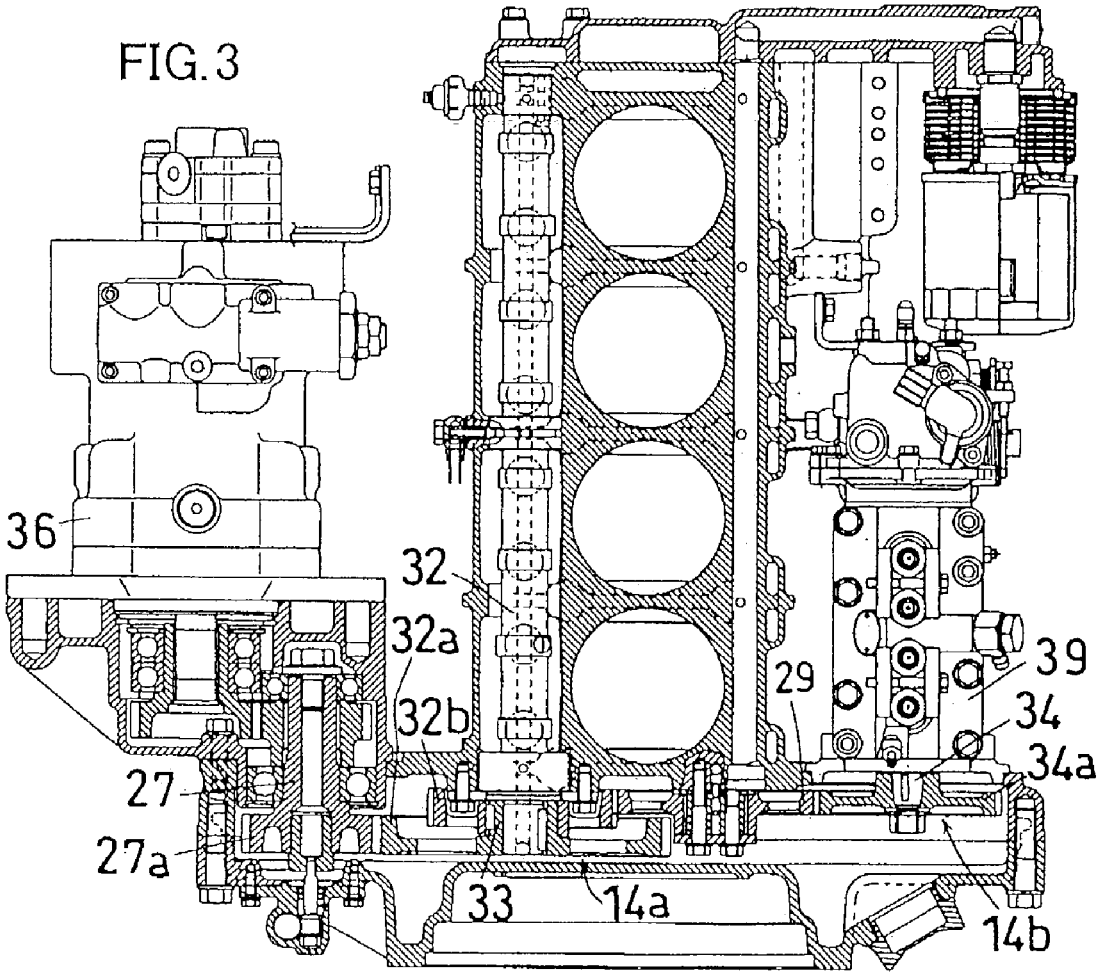
FIG. 3 is a cross sectional plan view of the engine shown in FIG. 2.
Figure 4:
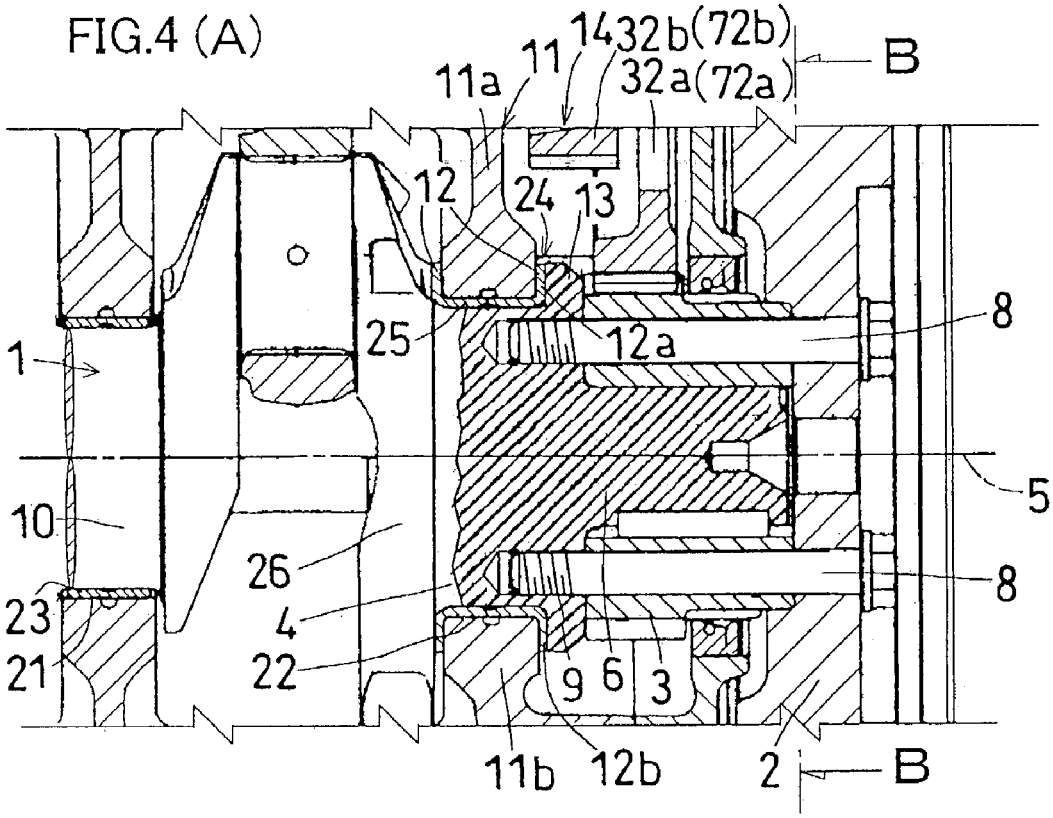
FIG. 4(A) is a vertical sectional side view in the vicinity of a crank gear of the engine shown in FIG. 2.
FIG. 4(B) shows a gear fitting shaft portion and a crank gear assembled together in section when seen along a line B—B in FIG. 4(A)
FIG. 4(C) is a decomposed view of an end bearing metal.
Figure 4:
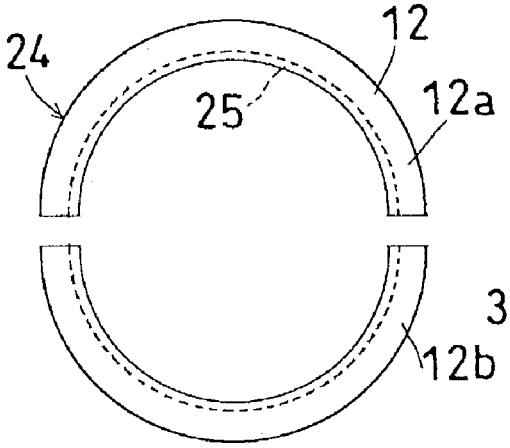
Figure 4:
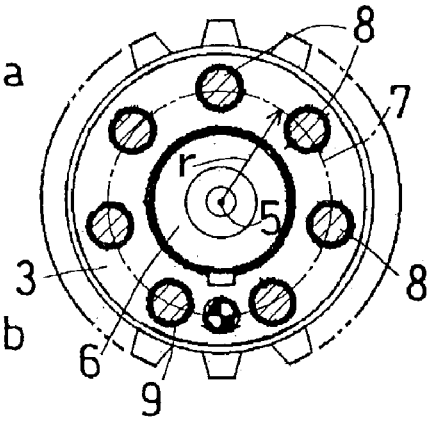

As shown in FIGS. 1(A) and 1(B), in the case of the gear train 14, 114 of the engine of either of the specifications, the crank gear 3 is attached to the crank shaft 1. The basic gear 32*a* and the second gear 32*b* are attached to a valve operating cam shaft 72 of the gear attaching shaft 32. Each of the idle gears 29 and 129 is attached to an idle gear shaft fixed to a rear surface of a cylinder block. Each of pump input gears 34*a* and 134*a* is attached to each of pump input shafts 34 and 134, respectively. However, the respective idle gears 29 and 129 have idle gear shafts arranged differently from each other. As shown in FIG. 3, the basic gear 32*a* has a boss 33 extending longitudinally of its center axis. The second gear 32*b* is attached to the boss 33 through press fitting. The second gear 32*b* is press fitted into the boss 33 of the basic gear 32*a* and is attached to the valve operating cam shaft 72 together with the basic gear 32*a*.

Further, as shown in FIGS. 1(A) and 1(B), in the case of the gears near the gear train 14, 114 of the engine of either of the specifications, the first secondary balancer gear 37*a* is attached to the first secondary balancer shaft 37. Each of the second secondary balancer gears 35*a* and 135*a* is attached to the second secondary balancer shaft 35. The primary balancer gear 38*a* is attached to the primary balancer shaft 38. An output take-out gear 27*a* is attached to an output take-out shaft 27 toward a working device 36.

The working device 36 comprises a hydraulic working pump and has the output take-out shaft 27 which is a side PTO axis of a full load take-out. Approximate whole amount of an outgoing output from the engine is outputted from the take-out shaft 27. Further, as shown in FIG. 3, every gear of the gear train extending from the crank shaft 1 to the working device 36 receives so large a force that each of the crank shaft 1, the valve operating cam shaft 32 and the output take-out shaft 27 which support it is beared at a plurality of portions in order for each of the gears to hardly incline.

Main parts are arranged in common on a left side surface of the engine as follows.

Figure 5:
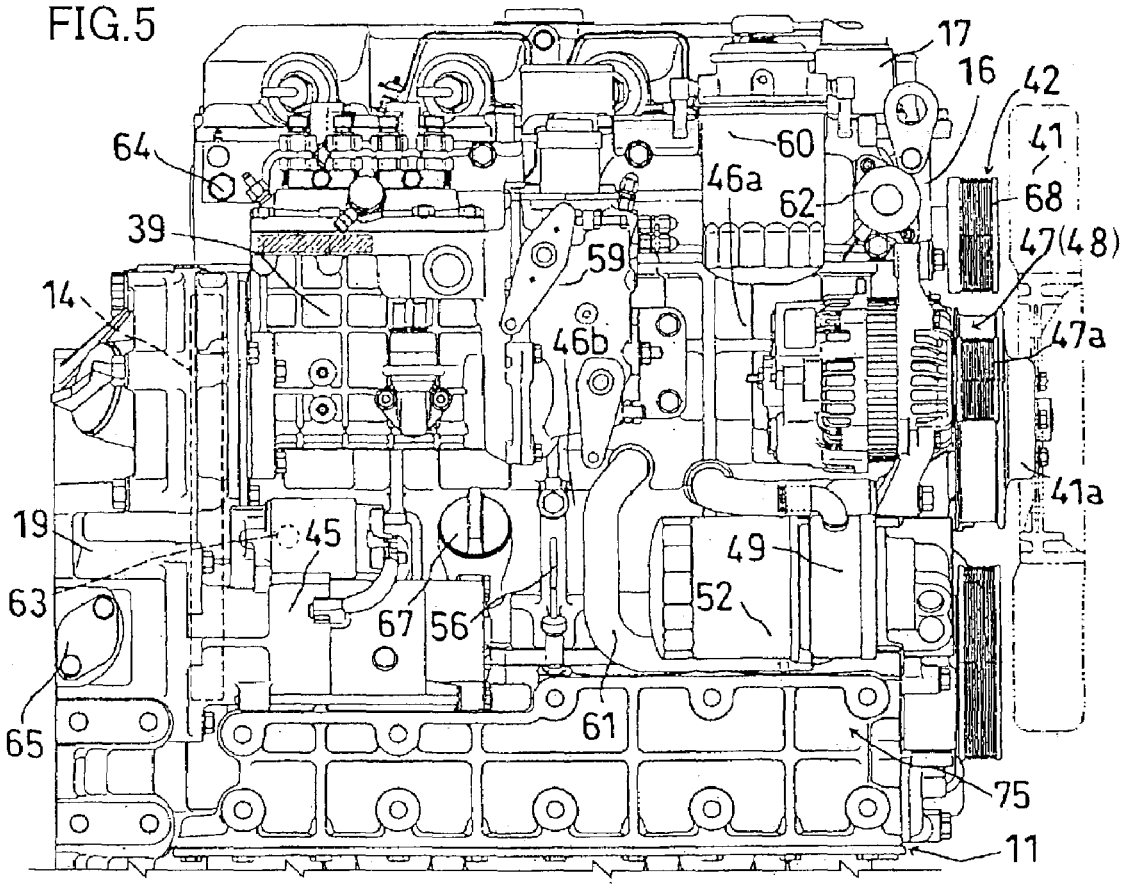
FIG. 5 is a left side view of the engine shown in FIG. 2.

As shown in FIG. 5, a tensioner 47 of a wrapping transmission device 42 and the fuel injection pump 39 (the fuel supply pump 139 in the case of the common rail specification) are separately arranged in a front and rear direction on a left side of the cylinder block 11. The tensioner 47 is arranged forward and the fuel injection pump 39 is arranged rearward. A belt transmission device and a generator 48 are employed for the wrapping transmission device 42 and the tensioner 47, respectively. The generator 48 and the fuel injection pump 39 are positioned leftwardly of an upper side portion 46*a* of the cylinder block 11 and substantially at the same height. An oil cooler 49 and a starter motor 45 are separately arranged in the front and rear direction leftwardly of a mid portion 46*b* in a vertical direction of the cylinder block 11. The oil cooler 49 is positioned forward and the starter motor 45 is arranged rearward. The oil cooler 49 and the starter motor 45 are positioned at substantially the same height. When seen from a left side of the cylinder block 11, an oil level gauge 56 has a handle arranged between an oil filter 52 attached to a rear portion of the oil cooler 49 and the starter motor 45.

The other parts are arranged in common on the left side surface of the engine as follows.

As shown in FIG. 5, a governor 59 is assembled to a front end portion of the fuel injection pump 39. A fuel filter 60 is arranged leftwards of a cylinder head 16 above the generator 48. A cooling water pipe 61 for the oil cooler 49 is arranged so that it extends from below the governor 59 to a space between the cylinder block 11 and the oil filter 52. An EGR solenoid valve 62 which controls exhaust circulation amount is arranged leftwards of the cylinder head 16, forwardly of the fuel filter 60 and above the generator 48. When seen from the left side of the engine, an oil switch 63 which senses a reduction of oil pressure is arranged between the oil injection pump 39 and the starter motor 45. A water temperature sensor 64 attached to the cylinder head 16 is exposed rearwards of the fuel injection pump 39. A flywheel accommodating case 19 is provided with a timing confirmation window 65 rearwardly of the starter motor 45. A gear matching mark of the gear train 14 is confirmed through this timing confirmation window 65. When seen from the left side of the engine, an oil supply port 67 is arranged above an end portion near the oil level gauge 56 of the starter motor 45 and below the fuel injection pump 39. Since the fuel injection pump 39 is positioned leftwards, as a mater of course, a fuel pipe is arranged leftwards. In the event that a reserve tank, an air cleaner and an oil drain hole are provided, they are arranged on the left side from which maintenance is carried out. Parts are arranged in common on the right side surface of the engine as follows.

Figure 6:
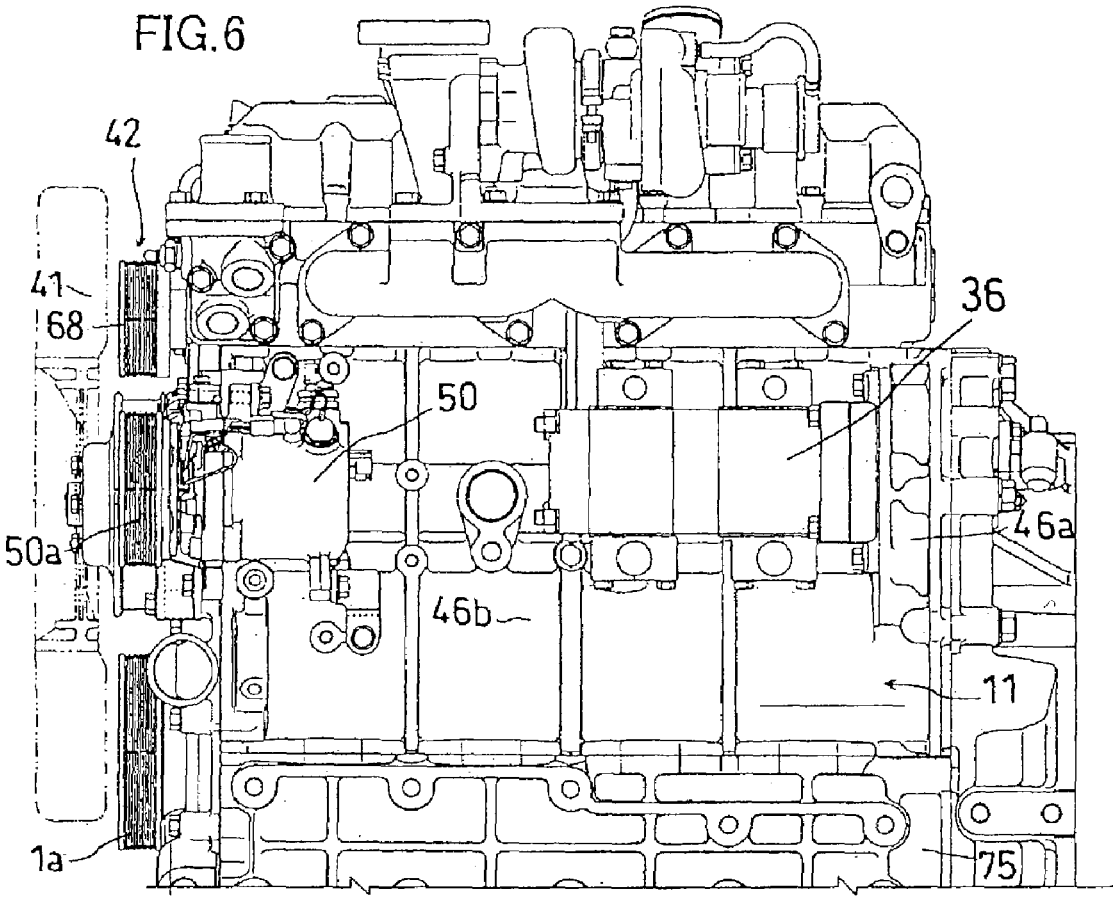
FIG. 6 is a right side view of the engine shown in FIG. 2.

As shown in FIG. 6, a pair of working devices 50 and 36 are separately arranged in the front and rear direction rightwardly of the upper side portion 46*a* of the cylinder block 11. The front working device 50 is a working air compressor and the rear working device 36 is the working oil pump. They are arranged at substantially the same height.

Parts are arranged in common on a front surface of the engine as follows.

Figure 7:
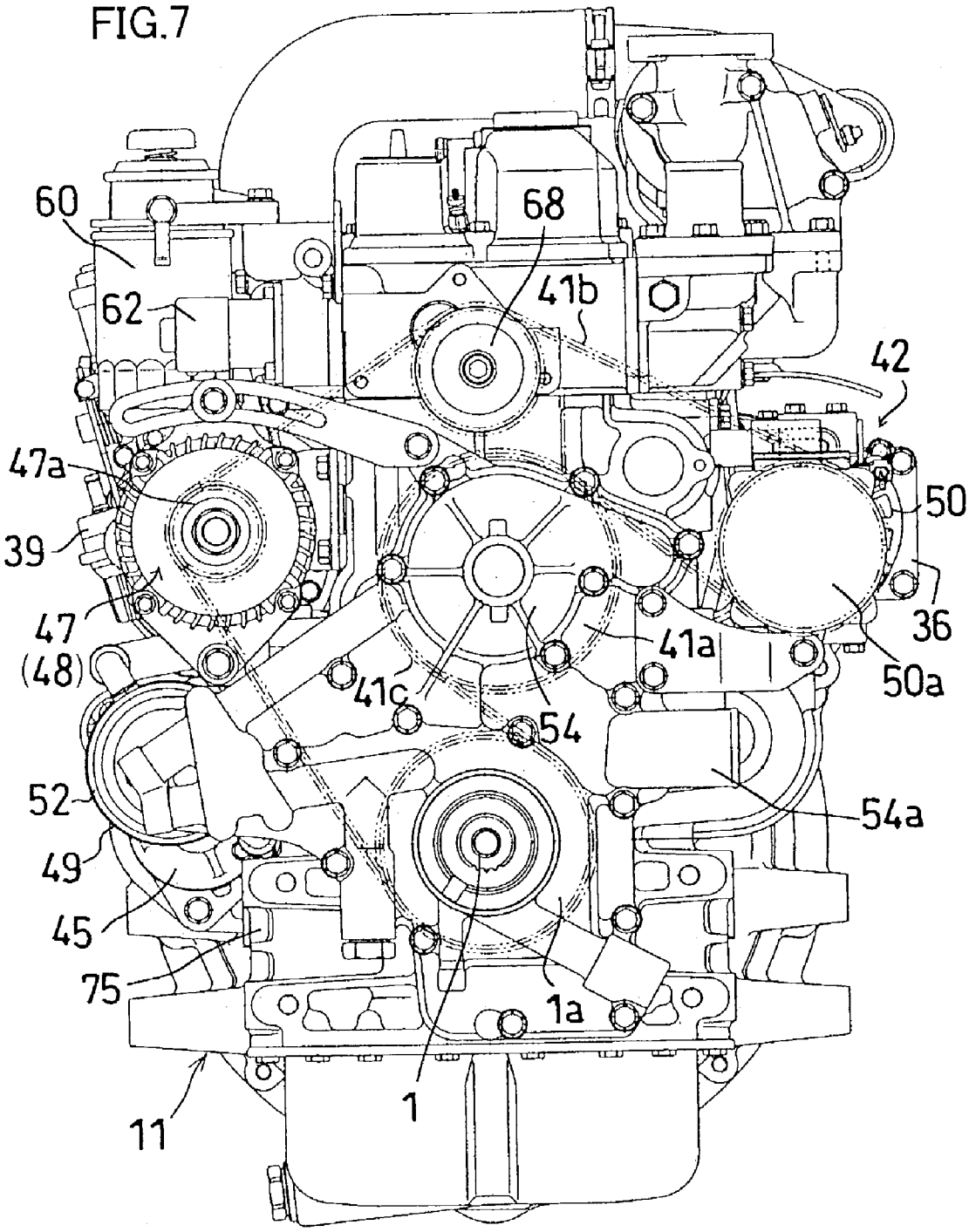
FIG. 7 is a front view of the engine shown in FIG. 2.
Figure 8:
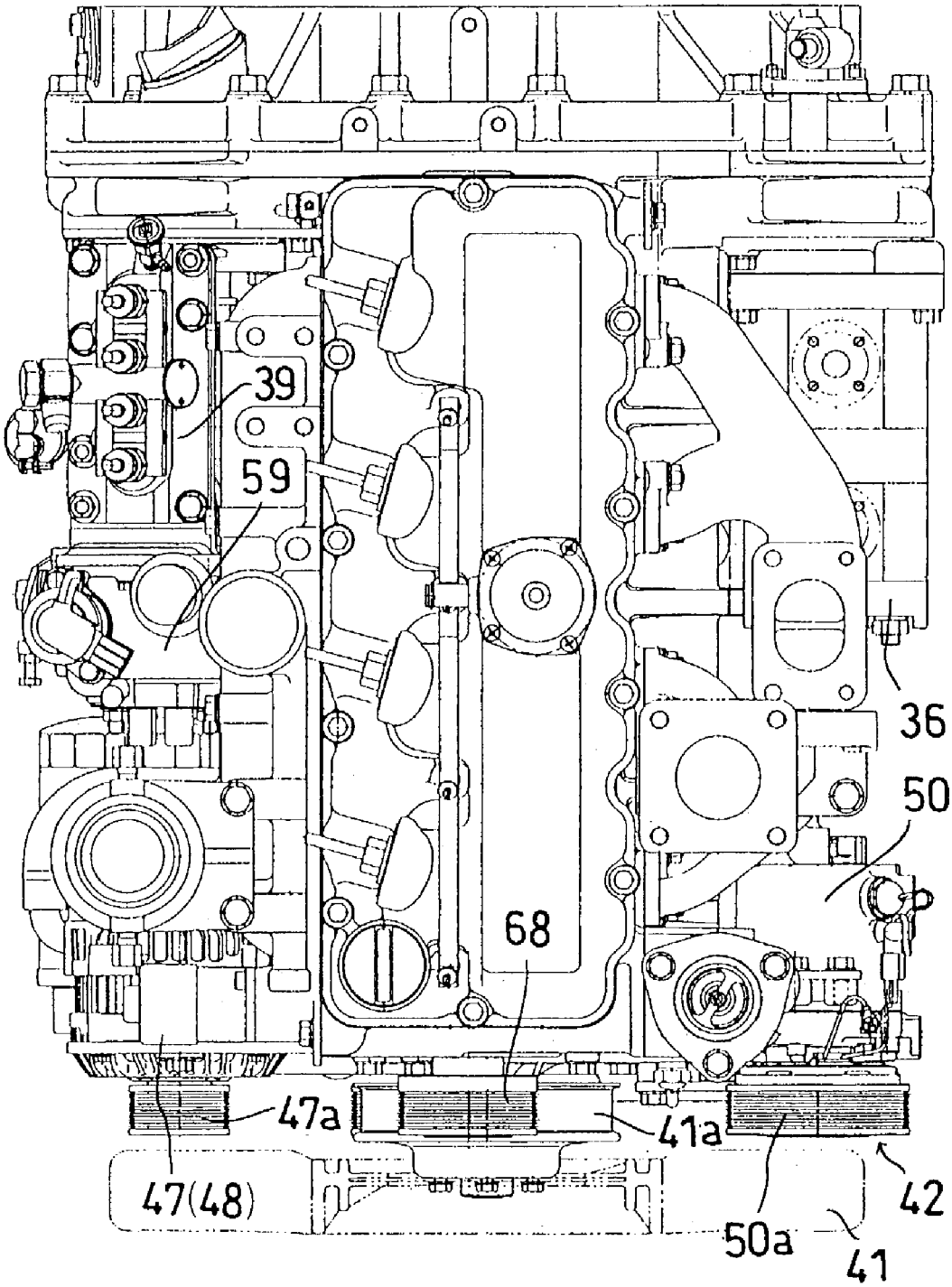
FIG. 8 is a plan view of the engine shown in FIG. 2.

As shown in FIG. 7, a tension pulley 47*a* of the belt tensioner 47 and a driven pulley 50*a* of the working device 50 are separately arranged leftwardly of a cooling fan pulley 41*a* and rightwardly thereof, respectively. A driving pulley 1*a* attached to the crank shaft 1 is arranged below the cooling fan pulley 41*a*. A fan belt 41*b* is wrapped around the driving pulley 1*a*, the tension pulley 47*a* and the driven pulley 50*a* so that its inner peripheral surface contacts them. The fan belt 41*b* is wrapped around the cooling fan pulley 41*a* so that its outer peripheral surface contacts it. A cooling water induction pipe 54*a* of a water pump 54 is arranged between the driven pulley 50*a* and the driving pulley 1*a*. Part of the fan belt 41*b* returns toward the cooling fan pulley 41*a* between the driven pulley 50*a* and the driving pulley 1*a*. This return portion 41*c* is wrapped around the cooling fan pulley 41*a*. An idle pulley 68 is arranged above the cooling fan pulley 41*a*. Part of the fan belt 41*b* is lifted up between the tension pulley 47*a* and the driven pulley 50*a* and is wrapped around the idle pulley 68 so that its inner peripheral surface contacts the idle pulley 68 in order for this part not to contact the cooling fan pulley 41*a*. Employed for the fan belt 41*b* is a poly V belt which has an inner peripheral surface provided with mountain-like projections along a longitudinal direction.

The crank shaft 1 has a common bearing structure as follows.

As shown in FIG. 4(A), the cylinder block 11 is provided with an intermediate bearing hole 21 and an end bearing hole 22. An intermediate bearing metal 23 is internally fitted into the intermediate bearing hole 21 to radially bear the intermediate journal 10 of the crank shaft 1. An end bearing metal 24 is internally fitted into the end bearing hole 22 to radially bear the end journal 4 of the crank shaft 1 and at the same time thrust bear the crank shaft 1. The end journal 4 has a diameter larger than a diameter of the intermediate journal 10.

The end bearing metal is attached by a common structure as follows.

As shown in FIGS. 4(A) and 4(C), this end bearing metal 24 comprises a cylindrical radial bearing metal 25 for the radial bearing and a pair of thrust bearing metals 12 for the thrust bearing. As shown in FIG. 4(A), the pair of thrust bearing metals 12 are provided in the shape of flanges at the opposite ends of cylindrical radial bearing metal 25. Therefore, the end bearing metal 24 has a circular ring structure horizontal U-shaped in section. As shown in FIG. 4(A), a front thrust bearing metal 12 is arranged along a front opening peripheral edge portion of the end bearing hole 22 and receives a crank arm 26 of the crank shaft 1. A rear thrust bearing metal 12 is arranged along a rear opening peripheral edge portion of the end bearing hole 22. A thrust flange portion 13 is provided between the end journal 4 and a crank gear fitting shaft portion 6 to be mentioned later. The thrust flange portion 13 is received by the rear thrust bearing metal 12. As shown in FIG. 4(A), each of the cylinder block 11 and the thrust bearing metal 12 is divided by a boundary surface along an axis 5 of the crank shaft 1 to form vertically divided structures. Therefore, as shown in FIG. 4(C), the end bearing metal 24 is divided into a pair of divided metal parts each of which has a semi-circular ring structure and is fitted into a half segment of the end bearing hole 22. In order to attach the end bearing metal 24, the respective divided metal parts 12*a* and 12*b* are temporarily attached to the respective divided block parts 11*a* and 11*b* with grease or the like. The crank shaft 1 is disposed on one divided block portion 11*a* so as to span and the other divided block part 11*b* is placed from above the crank shaft 1. Thus the end bearing metal 24 is attached when assembling the cylinder block 11.

The crank gear 3 is attached by the following common structure.

As shown in FIG. 4(A), the crank gear fitting shaft portion 6 projects from the end journal 4 on a side of the flywheel 2 of the crank shaft 1 in a direction of the crank axis 5. The crank gear 3 externally clearance fits onto the gear fitting shaft portion 6. As shown in FIG. 4(B), when seen in a direction parallel to the crank axis 5, seven attaching bolts 8 are spaced apart from each other at an equal interval on an imaginary circle 7 having a predetermined radius (r) from the crank axis 5. As shown in FIG. 4(A), these attaching bolts 8 extend through the flywheel 2 and the crank gear 3 and engage with the internally threaded portion 9 within the end journal 4. The attaching bolts 8 exert a fastening force which holds the crank gear 3 between the flywheel 2 and the end journal 4 and fixes it thereto. Cast iron is employed for the material of the crank shaft 1 and steel is utilized for the material of the crank shaft 3.

The structures within the engine are common on the following points.

Figure 9:
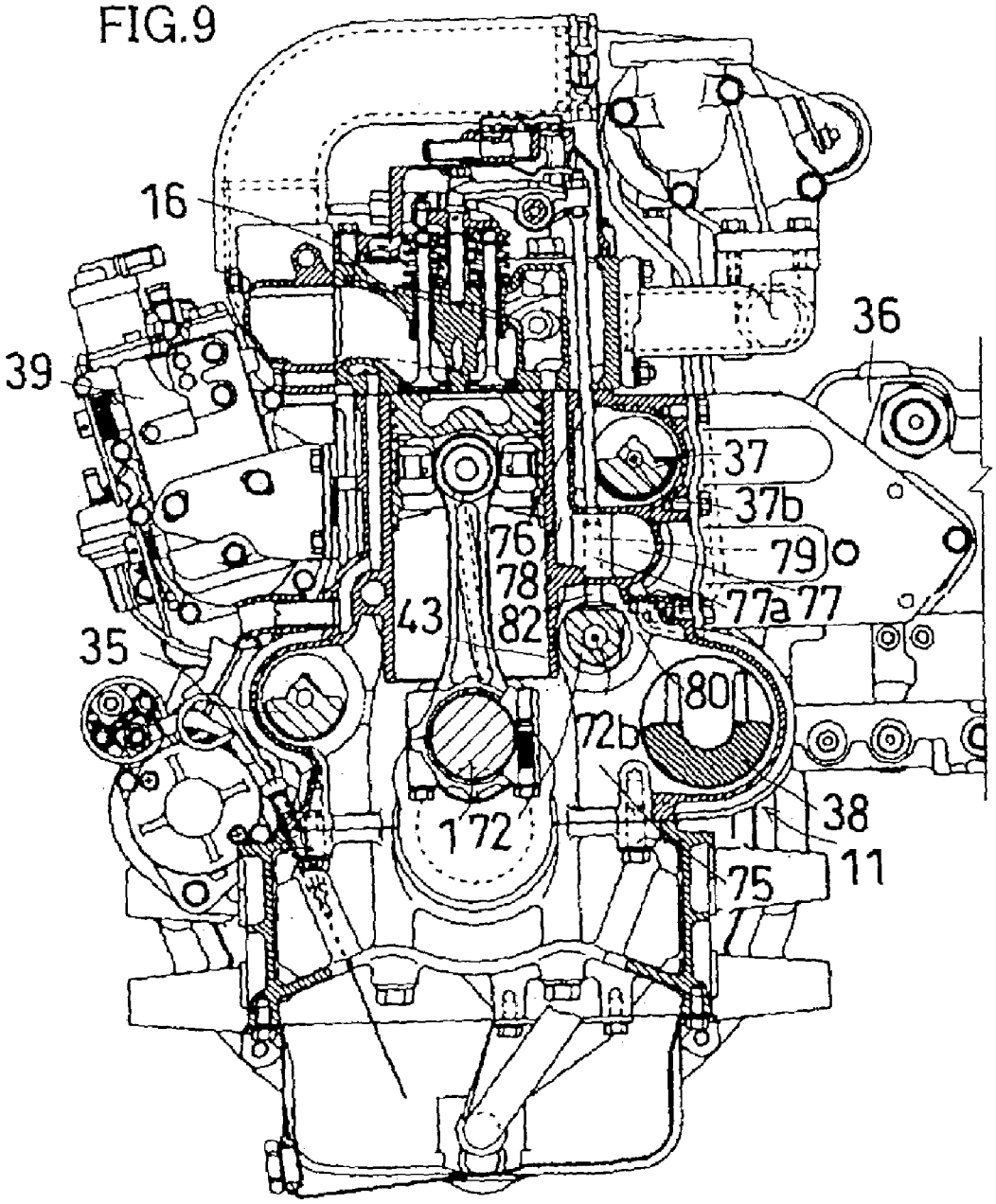
FIG. 9 is a vertical sectional front view of the engine in FIG. 2.

As shown in FIG. 9, assuming that a side of the cylinder head 6 is upper and a side to which the crank chamber 75 projects is horizontal, the first secondary balancer shaft 37 and the valve operating cam shaft 72 are arranged on one horizontal side of the cylinder 43. A horizontal side area of the cylinder 43 is imagined to be vertically and equally divided into upper, middle and lower three portions. The first secondary balancer shaft 37 has a center axis 37*b* positioned in the upper portion area and the valve operating cam shaft 72 has a center axis 72*b* positioned in the lower portion area. The second secondary balancer shaft 35 is positioned obliquely and downwardly of the other horizontal side of the cylinder 43. The primary balancer shaft 38 is positioned obliquely and downwardly of one horizontal side of the valve operating cam shaft 72.

The shafts are arranged in the following common way.

As shown in FIG. 9, the valve operating device has a push rod 76 inserted into a space defined between the cylinder 43 and the secondary balancer shaft 37 in the upper portion area. There is provided a side water passage 77 running along a spanning direction of the crank shaft 1, between the secondary balancer shaft 37 and the valve operating cam shaft 72. In order to introduce cooling water from a radiator into a cylinder jacket 78 of the multi-cylinder block 11 through the side water passage 77, the secondary balancer shaft 37, the side water passage 77 and the valve operating cam shaft 72 are arranged vertically along walls of the cylinder jacket 78 and the cylinder 43.

The side water passage and their surroundings are common on the following points.

Figure 10:
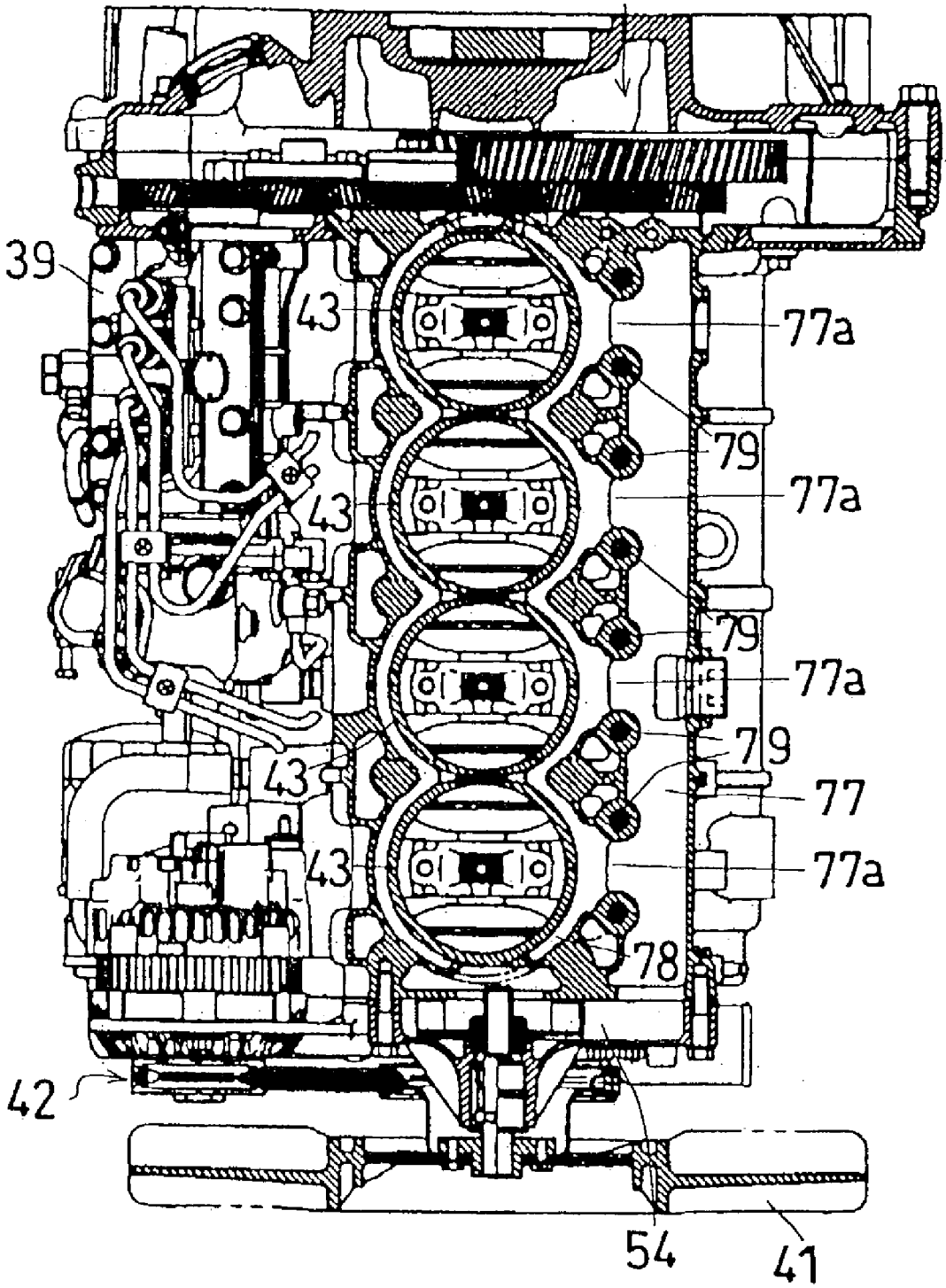
FIG. 10 is a cross sectional plan view of the engine shown in FIG. 2.

As shown in FIG. 9, the valve operating cam shaft 72 is arranged below the cylinder jacket 78. The side water passage 77 has an outlet 77*a* opposed to a lower portion of the cylinder jacket 78. As shown in FIG. 10, the side water passage 77 passes by sides of the cylinders 43 and is provided with a plurality of outlets 77*a* to the cylinder jacket 78. These outlets 77*a* are arranged at the opposite end portions and a middle portion of the side water passage 77. Every outlet 77*a* faces a top portion of one horizontal side of every cylinder 43. A tappet guide hole 79 of the valve operating device is provided within a wall between a pair of adjacent outlets 77*a* and 77*a*. As shown in FIG. 9, a valve operating cam chamber 80 communicates with the crank chamber 75 therebelow, so that a mushroom tappet 82 can be inserted from the crank chamber 75 into the tappet guide hole 79 through the valve operating cam chamber 80. The mushroom tappet is inserted here.

A method for producing the engine of every specification is outlined as follows.

In order to produce the engine of the injection pump specification as shown in FIG. 1(A) and the engine of the common rail specification as shown in FIG. 1(B), the engines of the respective specifications are produced alternatively through a common part.

The engine of every specification has the following non-common parts.

An injection system from the fuel supply pump 39 to the fuel injection nozzle of the engine of the injection pump specification as shown in FIG. 1(A); an injection pump input shaft 34; the injection pump input gear 34*a* and the idle gear 29 of the injection pump specification; and the second secondary balancer gear 35*a* of the injection pump specification.

An injection system from the fuel supply pump 139 to the fuel injection nozzle of the engine of the common rail specification as shown in FIG. 1(B); the supply pump input shaft 134; the supply pump input gear 134*a*; the idle gear 129 of the common rail specification; and the second secondary balancer gear 135*a* of the common rail specification.

The engine of every specification has the following common parts.

All of the parts are common except the above-mentioned non-common parts. As for the gear train 14, 114, the crank gear 3 and the basic gear 32*a* are common parts.

The method for producing an engine of every specification is as follows.

In order to produce the engines of the injection pump specification and the common rail specification, the method employs a common part for each of the gear trains 14 and 114 and alternatively produces the engines of the respective specifications through the common part.

As shown in FIGS. 1(A) and 1(B), the engine of every specification is arranged so that a pair of gears 32*a* and 32*b* are attached to a gear attaching shaft 32. One gear 32*a* of the paired gears 32*a* and 32*b* serves as a basic gear and the other gear 32*b* serves as a second gear. The basic gear 32*a* and the crank gear 3 are employed as common parts for each of the gear trains 14 and 114. In the case of producing the engine of either of the specifications, the basic gear 32*a* and the crank gear 3 of the common parts are attached to the gear attaching shaft 32 and the crank shaft 1, respectively. The basic gear 32*a* and the crank gear 1 constitute the basic gear train 14*a*.

As shown in FIG. 1(A), in the case of producing the engine of the injection pump specification, the second gear 32*b* is attached to the gear attaching shaft 32 as well as the basic gear 32*a*. The second gear 32*b*, the injection pump input gear 34*a* and the idle gear 29 constitute the second gear train 14*b*. The second gear train 14*b* and the basic gear train 14*a* define a gear train 14 of a double-layer structure. Through this gear train 14, power of the crank shaft 1 can be transmitted to the fuel injection pump 39.

As shown in FIG. 1(B), in the case of producing the engine of the common rail specification, the idle gear 129 and the supply pump input gear 134 form an extended gear train 14*c*. The idle gear 129 engages with the basic gear 32*a*. The extended gear train 14*c* and the basic gear train 14*a* define a gear train 114 of a single-layer structure. Through the gear train 114, the power of the crank shaft 1 can be transmitted to the fuel supply pump 139.

As regards the way to attach the other common parts, there is no difference between the engines of the respective specifications. They are attached in an ordinary way. The above-mentioned method uses the basic gear 32*a* and the crank gear 3 as the common parts for each of the gear trains 14 and 114. However, only the basic gear 32*a* is employed as the common part and the crank gear 3 may be utilized as an exclusive part. More specifically, according to the above method, in the case of producing the engine of either of the specifications, at least the basic gear 32*a* of the common part is attached to the gear attaching shaft 32 and constitutes a basic gear train 14*a* with the crank gear 1.

What is claimed is:

1. An engine of a fuel injection pump specification which interlockingly operates a pump (39) for feeding fuel under pressure, by power of a crank shaft (1), the engine comprising:

a gear attaching shaft (32) having an end to which a pair of gears (32*a*) and (32*b*) is arranged to be mounted;

both of the paired gears (32*a*) and (32*b*) mounted to the gear attaching shaft (32);

one gear (32*a*) of the paired gears (32*a*) and (32*b*) which serves as a basic gear and the other gear (32*b*) which serves as a second gear, the basic gear (32*a*) forming a basic gear train (14*a*) with a crank gear (1), the second gear (32*b*) defining a second gear train (14*b*) with an injection pump input gear (34*a*), the basic gear train (14*a*) and the second gear train (14*b*) constituting a gear train (14) of a double-layer structure, through which the power of the crank shaft (1) is transmitted to the fuel injection pump (39);

wherein the second gear train (14*b*) has a gear module smaller than a gear module of the basic gear train (14*a*).

2. An engine which interlockingly operates a pump (39, 139) for feeding fuel under pressure, by power of a crank shaft (1), the engine comprising:

a gear attaching shaft (32) having an end to which a pair of gears (32*a*) and (32*b*) is arranged to be mounted;

at least one gear (32*a*) of the paired gears (32*a*) and (32*b*) mounted to the gear attaching shaft (32); and a gear train (14, 114) comprising the at least one gear (32*a*) of the paired gears (32*a*) and (32*b*), through which the power of the crank shaft (1) is transmitted to the pump (39, 139);

wherein a crank gear (3) which defines the gear train (14, 114) is arranged at a position adjacent a flywheel (2); and wherein the crank gear (3) clearance fits onto the crank shaft (1).

3. The engine as set forth in claim 2, wherein a plurality of attaching bolts (8) are arranged on an imaginary circle (7) having an axis (5) of the crank shaft (1) as a center and extend through the flywheel (2) so as to engage with an internally threaded portion (9) within the crank shaft (1), when the thus exerted fastening force fastens the crank gear (3) and the flywheel (2) together to the crank shaft (1), the attaching bolt (8) being made to extend through the crank gear (3) to hold the crank gear (3) between the flywheel (2) and an end journal (4) on a side of the flywheel (2).

4. The engine as set fort in claim 3, wherein the end journal (4) has an outer diameter made larger than an outer diameter of the other end journal (10) of the crank shaft (1), the end journal (10) having an interior area formed with the internally threaded portion (9).

5. An engine which interlockingly operates a pump (39, 139) for feeding fuel under pressure, by power of a crank shaft (1), the engine comprising:

a gear attaching shaft (32) having an end to which a pair of gears (32*a*) and (32*b*) is arranged to be mounted;

at least one gear (32*a*) of the paired gears (32*a*) and (32*b*) mounted to the gear attaching shaft (32); and a gear train (14, 114) comprising the at least one gear (32*a*) of the paired gears (32*a*) and (32*b*), through which the power of the crank shaft (1) is transmitted to the pump (39, 139);

wherein the gear attaching shaft (32) is made to serve as a valve operating cam shaft (72), one gear (32*a*) of the paired gears (32*a*) and (32*b*) serving as the basic gear (32*a*) which plays a role of a valve operating cam gear (72*a*), when engaging the valve operating cam gear (72*a*) with the crank gear (3), on the assumption that a side of the cylinder head (16) is upper and a side to which a crank chamber (75) projects is horizontal, a balancer gear (37*a*) attached to a balancer shaft (37) engaging with the valve operating cam gear (72*a*) from above the cam gear (72*a*), the balancer shaft (37) being arranged on one horizontal side of a cylinder (43).

6. The engine as set forth in claim 5, wherein a side water passage (77) is provided along a spanning direction of the crank shaft (1), between the balancer shaft (37) and the valve operating cam shaft (72), when introducing cooling water from a radiator to a cylinder jacket (78) of a multi-cylinder block through the side water passage (77), the balancer shaft (37), the side water passage (77) and the valve operating cam shaft (72) being vertically arranged along walls of the cylinder jacket (78) and the cylinder (43).

7. The engine as set forth in claim 5, wherein the side water passage (77) is provided along the spanning direction of the crank shaft (1), when introducing cooling water from the radiator to the cylinder jacket (78) of the multi-cylinder block through the side water passage (77), the side water passage (77) which passes by sides of cylinders (43) being provided with a plurality of outlets (77*a*), the outlets (77*a*) being arranged at the opposite side portions and a middle portion in a longitudinal direction of the side water passage (77).

8. The engine as set forth in claim 7, wherein a tappet guide hole (79) is provided within a wall between a pair of adjacent outlets (77*a*) and (77*a*) of the side water passage (77).

9. A method for producing engines of an injection pump specification and a common rail specification, which uses a common part for each of gear trains (14) and (114) and alternatively manufactures the gear trains (14) and (114) of the engines of the respective specifications through the common part, the method comprising:

attaching a pair of gears (32*a*) and (32*b*) to a gear attaching shaft (32) of the engine of every specification, respectively;

making one gear (32*a*) of the paired gears (32*a*) and (32*b*) serve as a basic gear and the other gear (32*b*) serve as a second gear;

using the basic gear (32*a*) as the common part for each of the gear trains (14) and (114); and attaching at least the basic gear (32*a*) of the common part to the gear attaching shaft (32) and defining a basic gear train (14*a*) by the basic gear (32*a*) and the crank gear (1) in the case of producing the engine of either of the specifications, when producing the engine of the injection pump specification, the method attaching the second gear (32*b*) to the gear attaching shaft (32) with the basic gear (32*a*), defining a second gear train (14*b*) by the second gear (32*b*) and an injection pump input gear (34*a*), and constituting a gear train (14) of a double-layer structure by the second gear train (14*b*) and the basic gear train (14*a*), power of a crank shaft (1) being made to be transmitted to a fuel injection pump (39) through the gear train (14), when producing the engine of the common rail specification, the method defining an extended gear train (14*c*) by a supply pump input gear (134) and forming a gear train (114) of a single-layer structure by the extended gear train (14*c*) and the basic gear train (14*a*), the power of the crank shaft (1) being made to be transmitted to a fuel injection pump (139) through the gear train (114).

* * * * *